US006209637B1

(12) United States Patent
Wells

(10) Patent No.: US 6,209,637 B1
(45) Date of Patent: Apr. 3, 2001

(54) PLUNGER LIFT WITH MULTIPART PISTON AND METHOD OF USING THE SAME

(76) Inventor: Edward A. Wells, 14862 Cabo de Bara, Corpus Christi, TX (US) 78418

( * ) Notice: Subject to any disclaimer, the term of this patent is extended or adjusted under 35 U.S.C. 154(b) by 0 days.

(21) Appl. No.: 09/312,737

(22) Filed: May 14, 1999

(51) Int. Cl.[7] ..... E21B 43/00
(52) U.S. Cl. ..... 166/153; 166/372
(58) Field of Search ..... 166/372, 105, 166/153, 193, 155; 417/58, 56

(56) References Cited

U.S. PATENT DOCUMENTS 2,074,912 3/1937 Hutto .
3,090,316 5/1963 Montgomery .
3,412,798 * 11/1968 Gregston ..... 417/56
4,211,279 * 7/1980 Isaacks ..... 166/64
4,629,004 * 12/1986 Griffin ..... 166/372
6,045,335 * 4/2000 Dinning ..... 417/59

* cited by examiner

*Primary Examiner*—David Bagnell
*Assistant Examiner*—Jennifer R. Dougherty
(74) *Attorney, Agent, or Firm*—G. Turner Moller

(57) ABSTRACT

A plunger lift for a hydrocarbon well includes a multipart piston that is dropped into the well in separate pieces. When the pieces reach the bottom of the well, they fall into an accumulation of the formation liquid in the bottom of the well and unite. Gas from the formation pushes the unit upwardly, pushing liquid above the piston toward the surface.

31 Claims, 3 Drawing Sheets

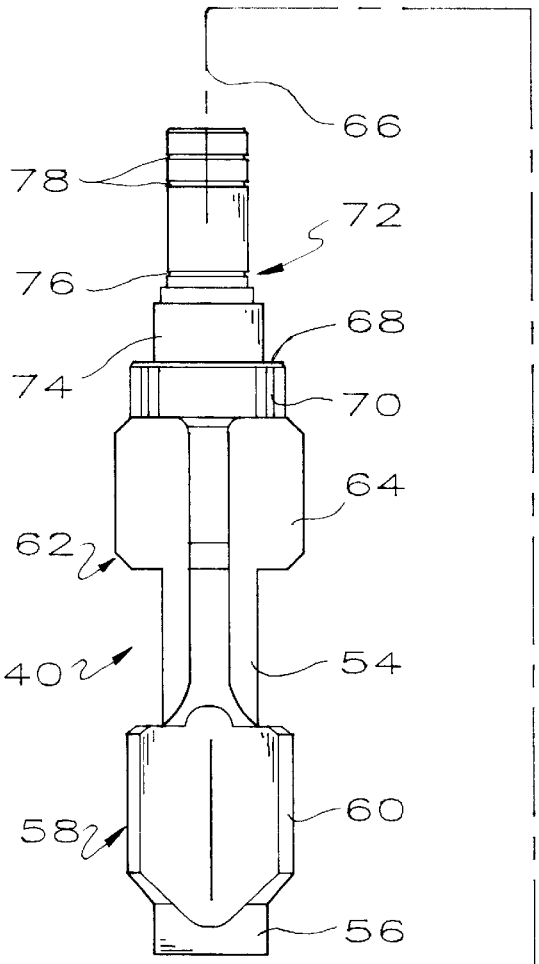
FIG. 2
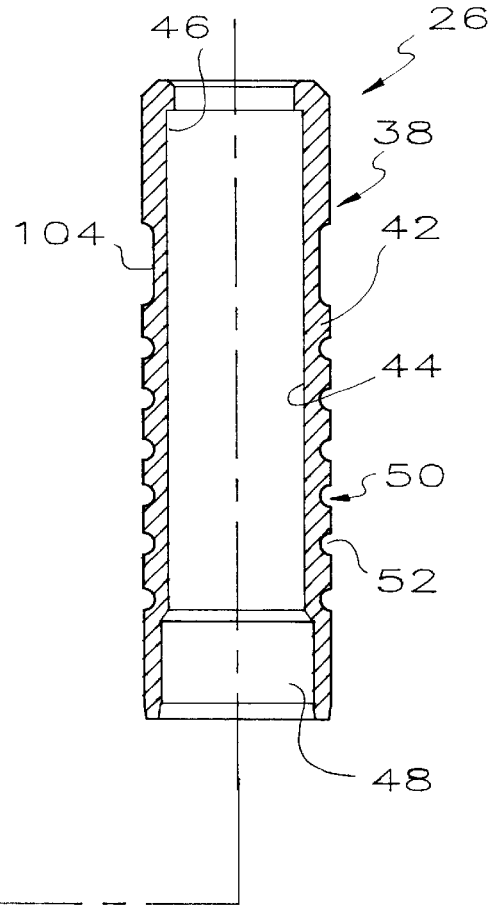
FIG. 3
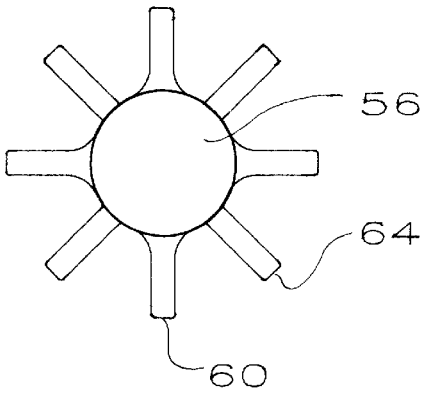
FIG. 4
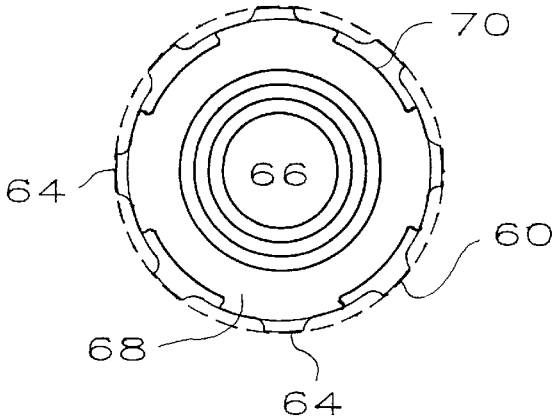

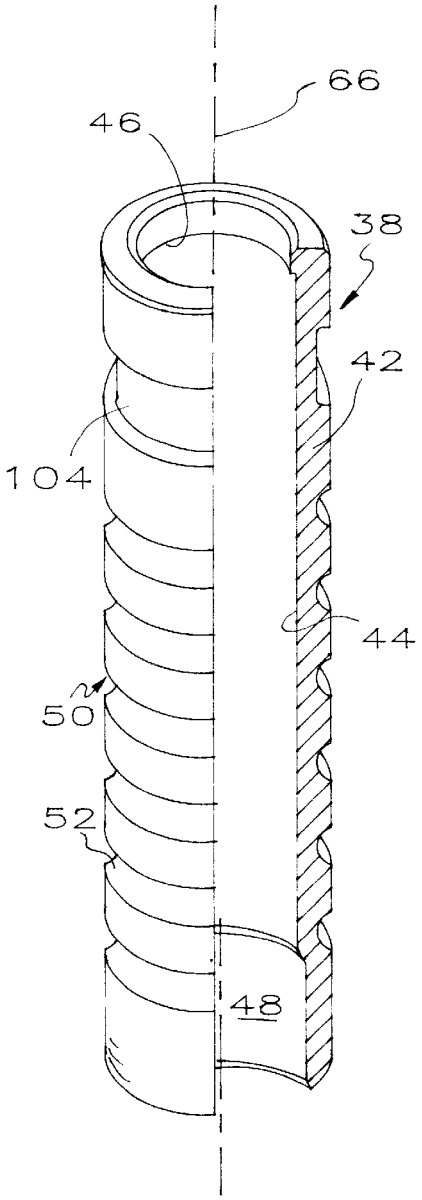
FIG.5
FIG.7
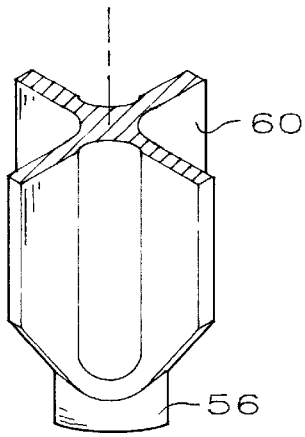
FIG.8
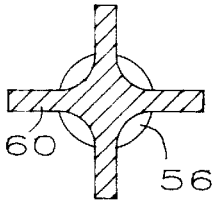
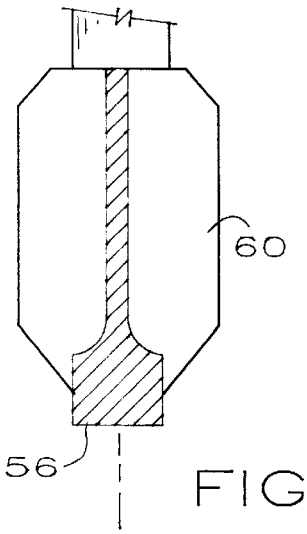
FIG.9
FIG.6
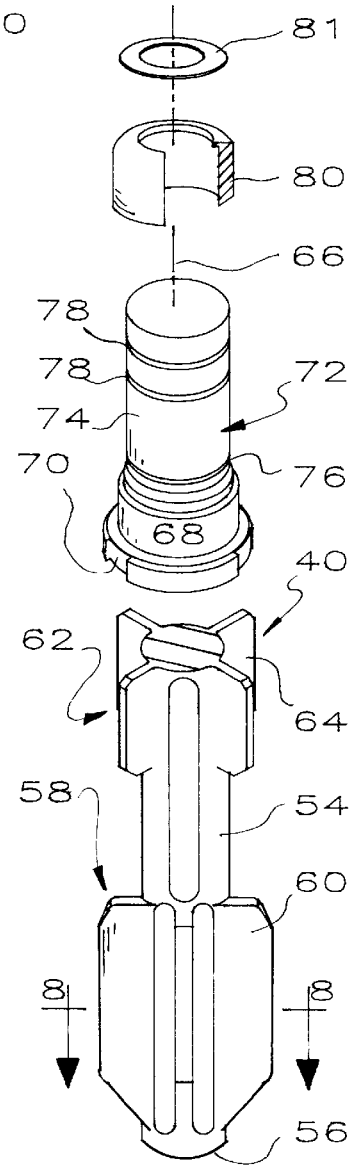

PLUNGER LIFT WITH MULTIPART PISTON AND METHOD OF USING THE SAME

This invention relates to a plunger lift system for moving liquids upwardly in a petroleum well.

BACKGROUND OF THE INVENTION

There are many different techniques for artificially lifting formation liquids from hydrocarbon wells. Reciprocating sucker rod pumps are the most commonly used in the oil field because they are the most cost effective, all things considered, over a wide variety of applications. Other types of artificial lift include electrically driven down hole pumps, hydraulic pumps, rotating rod pumps, free pistons or plunger lifts and several varieties of gas lift. These alternate types of artificial lift are more cost effective than sucker rod pumps in the niches or applications where they have become popular.

One of the developments that has evolved over the last thirty years are so-called tubingless completions in which a string of tubing, usually 2⅞" O.D., is cemented in the well bore and then used as the production string. Tubingless completions are never adopted where pumping a well is initially considered likely because sucker rod pumps have proved to be only slightly less than a disaster when used in a 2⅞" tubingless completions. Artificial lift in a 2⅞" tubingless completion is almost universally limited to gas lift or free pistons. Thus, tubingless completions are typically used in shallow to moderately deep wells that are believed, at the time a completion decision is made, to produce all or mostly gas, i.e. no more liquid than can be produced along with the gas.

Gas wells reach their economic limit for a variety of reasons. A very common reason is the gas production declines to a point where the formation liquids are not readily moved up the production string to the surface. Two phase upward flow in a well is a complicated affair and most engineering equations thought to predict flow are only rough estimates of what is actually occurring. One reason is the changing relation of the liquid and of the gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows down below some critical value, or stops, the liquid runs down the inside of the flow string and accumulates in the bottom of the well.

If sufficient liquid accumulates in the bottom of the well, the well is no longer able to flow because the pressure in the reservoir is not able to start flowing against the pressure of the liquid column. The well is said to have loaded up and died. Years ago, gas wells were plugged much quicker than today because it was not economic to artificially lift small quantities of liquid from a gas well. At relatively high gas prices, it is economic to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle. For example, the first technique is to drop soap sticks into the well. The soap sticks and some agitation cause the liquids to foam. The well is then turned to the atmosphere and a great deal of foamed liquid is discharged from the well. Later in its life cycle, when soaping the well has become much less effective, a string of 1" or 1½" tubing is run inside the production string. The idea is that the upward velocity in the small tubing string is much higher which keeps the liquid moving upwardly in the well to the surface. A rule of thumb is that wells producing enough gas to have an upward velocity in excess of 10'/second will stay unloaded. Wells where the upward velocity is less than 5'/second will always load up and die.

At some stage in the life of a gas well, these techniques no longer work and the only approach left to keep the well on production is to artificially lift the liquid with a pump of some description. The logical and time tested technique is to pump the accumulated liquid up the tubing string with a sucker rod pump and allow produced gas to flow up the annulus between the tubing string and the casing string. This is normally not practical in a 2⅞" tubingless completion unless one tries to use hollow rods and pump up the rods, which normally doesn't work very well or very long. Even then, it is not long before the rods cut a hole in the 2⅞" string and the well is lost. In addition, sucker rod pumps require a large initial capital outlay and either require electrical service or elaborate equipment to restart the engine.

Free pistons or plunger lifts are another common type of artificial pumping system to raise liquid from a well that produces a substantial quantity of gas. Conventional plunger lift systems comprise a piston that is dropped into the well by stopping upward flow in the well, as by closing the wing valve on the well head. The piston is often called a free piston because it is not attached to a sucker rod string or other mechanism to pull the piston to the surface. When the piston reaches the bottom of the well, it falls into the liquid in the bottom of the well and ultimately into contact with a bumper spring, normally seated in a collar or resting on a collar stop. The wing valve is opened and gas flowing into the well pushes the piston upwardly toward the surface, pushing liquid on top of the piston to the surface. Although plunger lifts are commonly used devices, there is more art than science to their operation.

A major disadvantage of conventional plunger lifts is the well must be shut in so the piston is able to fall to the bottom of the well. Because wells in need of artificial lifting are susceptible to being easily killed, stopping flow in the well has a number of serious effects. Most importantly, the liquid on the inside of the production string falls to the bottom of the well, or is pushed downwardly by the falling piston. This is manifestly the last thing that is desired because it is the reason that wells die. In response to the desire to keep the well flowing when a plunger lift piston is dropped into the well, attempts have been made to provide valved bypasses through the piston which open and close at appropriate times. Such devices are to date quite intricate and these attempts have so far failed to gain wide acceptance.

Disclosures of some interest relative to this invention are U.S. Pat. Nos. 2,074,912 and 3,090,316.

SUMMARY OF THE INVENTION

In this invention, a multipart piston includes separate pieces that are independently allowed to fall inside the production string toward the productive formation. The cross-sectional area of the separate pieces are such that upward flow of gas is substantially unimpeded and the pieces fall through an upwardly moving stream of gas and liquid. Thus, the piston of this invention is normally dropped into a well while it is flowing. This has a great advantage because the liquid in a film on the inside of the production string does not fall into the bottom of the well.

When the lower piece nears the bottom of the well, it falls into any liquid near the bottom of the well and contacts a bumper spring which cushions the impact of the device. When the upper piece reaches the lower piece, they unite into a single component that has a cross-sectional area comparable to existing plunger lift pistons, i.e. any gas entering the production string from the formation is under the piston and pushes it upwardly, thereby pushing any liquid upwardly in the well to the surface.

Preferably, one of the pieces is a sleeve having a central passage through which the gas flows as the sleeve falls in the well. The other piece is preferably a mandrel having a pin that fits into the sleeve and substantially blocks flow in the central passage when the pieces are united. The flow passage around the mandrel is basically on the outside as the it falls in the well. The mandrel provides one or more centralizers which hold the pin in the center of the production string to align with the central passage of the sleeve.

When the united components reach the well head at the surface, a decoupler separates the sleeve from the mandrel and allows the mandrel to fall toward the bottom of the well. Conveniently, a catcher holds the sleeve and then releases the sleeve after the mandrel is already on the way to the bottom.

A bypass for produced formation products is conveniently provided in the well head to insure that the sleeve and mandrel separate.

It is an object of this invention to provide an improved plunger lift and method of using the same.

A more specific object of this invention is to provide a multipart piston for a plunger lift in which sections of the piston move separately down into the well, unite near the bottom of the well and then move upwardly as a unit to move liquids toward the surface.

These and other objects of this invention will become more fully apparent as this description proceeds, reference being made to the accompanying drawings and appended claims.

BRIEF DESCRIPTION OF THE DRAWINGS

FIG. 2 is an exploded vertical cross-sectional view of the piston of this invention, showing the sleeve and mandrel;

FIG. 3 is a bottom view of the mandrel;

FIG. 4 is a top view of the mandrel;

FIG. 5 is a broken isometric view of the sleeve;

FIG. 6 is an isometric view of the mandrel, the top of the mandrel being broken away from the bottom for purposes of illustration;

FIG. 7 is a broken isometric view of the bottom of the mandrel, taken at 45° relative to FIG. 6;

FIG. 8 is a horizontal cross-sectional view of FIG. 6, taken substantially along line 8—8 thereof, as viewed in the direction indicated by the arrows; and FIG. 9 is a vertical cross-sectional view of the lower end of the mandrel of FIG. 6.

DETAILED DESCRIPTION

Figure 1:
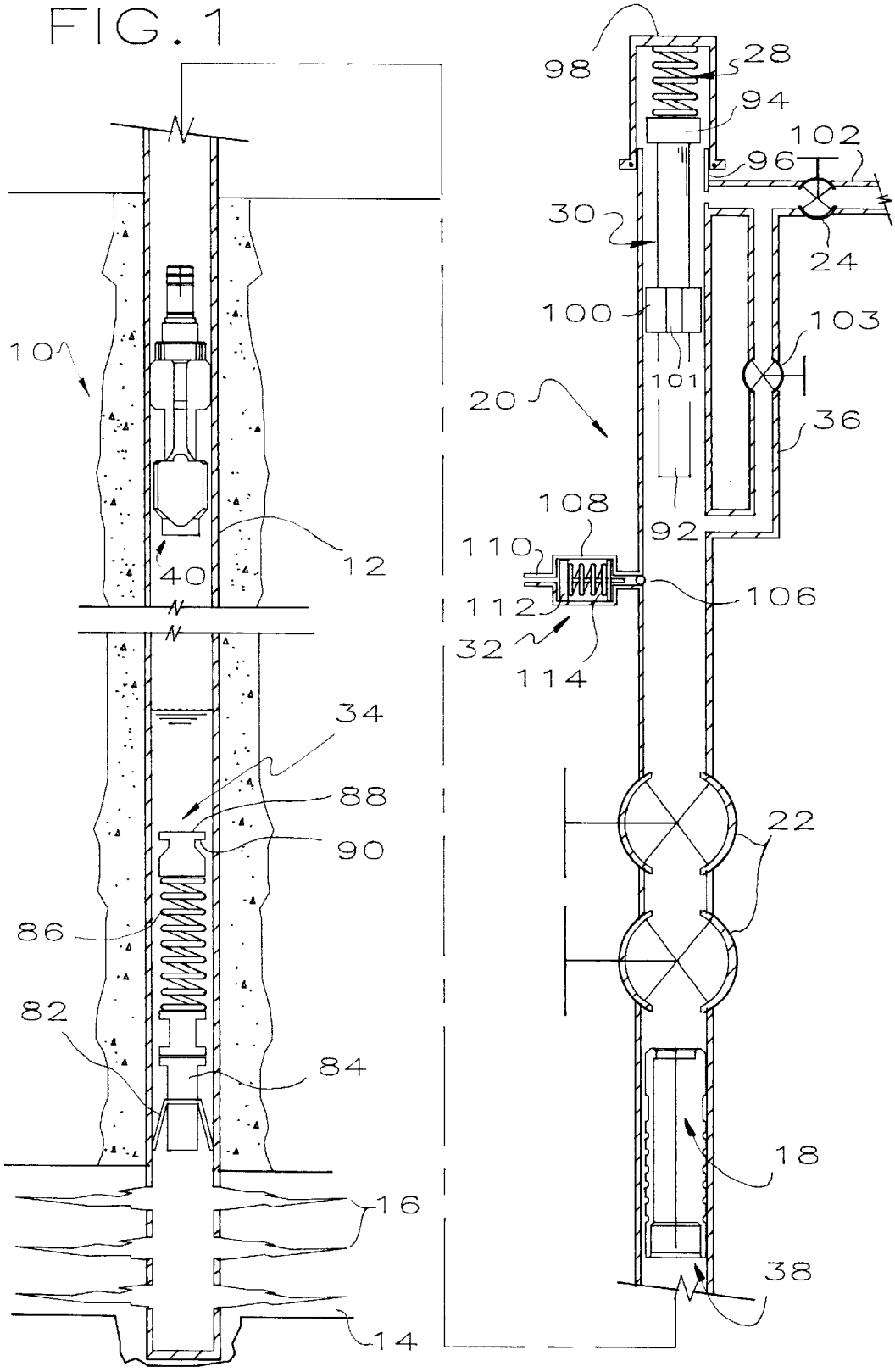
FIG. 1 is a schematic view of a well equipped with a plunger lift system of this invention.

Referring to FIGS. 1–9, a hydrocarbon well 10 comprises a production string 12 extending into the earth in communication with a subterranean hydrocarbon bearing formation 14. The production string 12 is typically a conventional tubing string made up of joints of tubing that are threaded together. Although the production string 12 may be inside a casing string (not shown), it is illustrated as cemented in the earth. The formation 14 communicates with the inside of the production string 12 through perforations 16. As will be more fully apparent hereinafter, the plunger lift 18 may be used to lift oil, condensate or water from the bottom of the well 10 which may be classified as either an oil well or a gas well.

In a typical application of this invention, the well 10 is a gas well that produces some formation liquid. In an earlier stage of the productive life of the well 10, there is sufficient gas being produced to deliver the formation liquids to the surface. The well 10 is equipped with a conventional well head assembly 20 comprising a pair of master valves 22 and a wing valve 24 delivering produced formation products to a surface facility for separating, measuring and treating the produced products.

The plunger lift 18 of this invention comprises, as major components, a piston 26, an upper bumper 28, a decoupler 30, a catcher assembly 32, a lower bumper 34 and a bypass 36 around the piston 26 when it is its uppermost position in the well head assembly 20.

The piston 26 is of unusual design and is made in at least two pieces which, in a preferred embodiment of the invention, comprises an upper sleeve 38 and a lower mandrel 40. The sleeve 38 comprises a tubular body 42 having a central passage 44, a fishing neck 46 at the upper end thereof and a sealing surface 48 at the lower end thereof.

The exterior of the sleeve 38 provides a seal arrangement 50 to minimize liquid on the outside of the sleeve 38 from bypassing around the exterior of the sleeve 38. The seal arrangement 50 may be of any suitable type, such as wire wound around the sleeve 38 providing a multiplicity of bristles or the like or may comprise a series of simple grooves or indentations 52. The grooves 52 work because they create a turbulent zone between the sleeve 38 and the inside of the production string 12 thereby restricting liquid flow on the outside of the sleeve 38.

The mandrel 40 is of more complex configuration and comprises a body 54 having a robust lower end 56 which takes repeated impacts against the lower bumper, a first centralizer section 58 providing a series of outwardly extending arms 60 and a second centralizer section 62 providing a series of outwardly extending arms 64. The arms 60 are preferably 90° out of phase with the arms 64 so the centralizer sections 58, 62 orient the axis 66 of the mandrel 40 substantially coincident with the axis of the sleeve 38 and of the production string 12. The arms 60, 64 preferably have the same outer dimension as the sleeve 38.

Above the centralizer section 62 is a circular plate 68 having a series of peripheral slots 70 providing a flow bypass between the centralizer arms 64. Above the plate 68 is a pin 72 which extends into the sleeve 38 and provides a frusto-conical sealing surface 74, a snap ring groove 76 and a pair of fishing grooves 78. The pin 72 is substantially shorter than the sleeve 38 so, in the upwardly moving or nested position of the piston 26, the pin 72 terminates below the fishing neck 46 of the sleeve 38.

A sealing member 80 slips over the pin 72 and fits onto the sealing surface 74 of the mandrel 40. A washer 81 may be provided above the sealing member 80 for abutting a snap ring (not shown) which fits in the groove 76 and holds the sealing member 80 in position. When the mandrel 40 nests inside the sleeve 38, the sealing member 80 seals against the sealing surface 48. The sealing member 80 may be of any suitable type and is shown as a Harbison-Fisher nylon seal ring, model 80-190H-10, 1¾" HR pump seal.

As will be more fully apparent hereinafter, the mandrel 40 is first dropped into the well 10, followed by the sleeve 38. The mandrel 40 and sleeve 38 accordingly fall separately and independently into the well 10, usually while the well 10 is producing gas and liquid up the production string 12 and through the well head assembly 20. By separately, it is meant that the mandrel 40 and sleeve 38 are not connected. By independently, it is meant that the mandrel 48 and sleeve 38 are capable of moving independently of one another even if they are tethered together in some fashion. When the mandrel 40 and sleeve 38 reach the bottom of the well, they nest together in preparation for moving upwardly.

In one aspect, the sleeve 38 and mandrel 40 each have a flow bypass so they separately fall easily into the well 10 even when there is substantial upward flow in the production string 12. When they reach the bottom of the well, they unite into a single component which substantially closes the flow bypasses, or at least restricts them, so gas entering through the perforations 16 pushes the piston 26 upwardly in the well and thereby pushes liquid, above the piston 26, upwardly toward the well head assembly 20.

Looked at in another perspective, the sleeve 38 and mandrel 40 each have a surface area which is selected so that they separately fall easily in the well but, when they are united into the piston 26, the piston 26 is pushed upwardly in the well thereby pushing any liquid upwardly toward the well head assembly 20. The selection of the surface areas of the sleeve 38 and mandrel 40 is preferably done so that a given pressure differential will move the mandrel 40 before moving the sleeve 38. In other words, the mandrel 40 is easier to move than the sleeve 38. The reason is that is if the mandrel 40 can be constructed so it always pushes from below, there is no tendency for the sleeve 38 to separate from the mandrel 40 during upward movement in the well 10.

This may be illustrated in the following example. A standard size 2⅞" tubing used as a production string weighs 6.5 #/foot and has a nominal internal diameter of 2.441" which, of course, is not perfect and which is interrupted in an assembled string by a gap in the coupling of adjacent joints. A conventional one piece plunger lift has an O.D. of about 2.330" and can successfully lift liquid from the bottom of a well. A piston 26 of this invention may have a sleeve 38 with an O.D. of 2.330" and an I.D. of 1.750" so the downwardly facing area of the sleeve 30 is approximately 1.857 square inches. A mandrel 40 for such a sleeve will have a plate 68 of an O.D. of 2.125" and its surface area is somewhat less than 3.547 square inches because of the slots 70. When the sleeve 38 is nested onto the mandrel 40, the O.D. of the sleeve 38 is slightly larger than the plate 68 as suggested by the dashed lines in FIG. 4. It will be seen that the area of the mandrel 40 is larger than the area of the sleeve 38 so that any pressure drop applies a greater force to the mandrel 40 than to the sleeve 38. In addition, the ratio of surface area to weight of the mandrel 40 is greater than the ratio of surface area to weight of the sleeve 38.

The upper bumper 28 is of conventional design and comprises a helical spring. Bumpers of this type are well known in the plunger lift art and are commercially available.

The lower bumper 34 sits, or is part of, a conventional collar stop 82 that is supported in the gap provided by couplings between adjacent joints of the production string 12. In a well (not shown) having a tubing string inside a casing string cemented in the earth, the lower bumper 34 typically sits in a seating nipple (not shown) in the tubing string. The lower bumper 34 includes a body 84, a relatively long spring 86 and an anvil 88 providing a conventional fishing neck 90. Because the mandrel 40 falls into the bottom of the well 10 when it is flowing, there is little or no liquid accumulated adjacent the formation 14. Thus, the mandrel 40 tends to strike the lower bumper 34 at higher velocities than conventional plunger pistons. For this reason, a longer, softer bumper spring is desired.

The decoupler 30 acts to separate the piston 26 when it reaches the well head assembly 20. The decoupler 30 comprises a rod 92 sized to pass into the top of the sleeve 38 and is fixed to a piston 94. The piston 94 is larger than a conduit 96 in which the rod 92 reciprocates and is thus prevented from falling into the well 10. The top of the well head assembly 20 is closed with a screw cap 98. A stop 100 on the rod 92 limits upward movement of the sleeve 38. A series of grooves 101, similar to the grooves 70, allow formation products to pass around the stop 100 and into a flow line 102 connected to the wing valve 24. It will be seen that the piston 26 moves upwardly in the well 10 as one piece. When the sleeve 38 passes onto the end of the rod 92, the rod 92 ultimately contacts the top of the pin 72, stopping upward movement of the mandrel 40 and allowing continued upward movement of the sleeve 38. The end of the rod 92, below the stop 100, is longer than the pin 72 so the mandrel 40 is pushed out of the sleeve 38 thereby releasing the mandrel 40 which falls toward the bottom of the well 10.

The bypass 36 helps prevent the piston 26 from sticking in the well head assembly 20 and may include a valve 103. The bypass 36 opens into the well head assembly 20 below the bottom of the sleeve 38 when it is in its uppermost position in the well head assembly 20. Thus, there will be a tendency of gas flowing through the well head assembly 20 to move through the bypass 36 rather than pinning the sleeve 38 against the stop 100.

A catcher 32 may be provided to latch onto the sleeve 38 and thereby hold it for a while to provide a delay period between successive cycles of the piston 26 and to make certain that the sleeve 38 and mandrel 40 fall separately toward the bottom of the well 10. To these ends, the sleeve 38 is provided with an elongated groove 104 to receive a ball detent 106 forced inwardly into the path of the sleeve 38 by an air cylinder 108 connected to a supply of compressed gas (not shown) through a fitting 110. A piston 112 in the cylinder 108 is biased by a spring 114 to a position releasing the ball detent 106 for movement out of engagement with the slot 104. Pressure is normally applied to the cylinder 108 thereby forcing the ball detent 106 into the path of travel of the sleeve 38. The exterior surfaces of the slot 104 are beveled to cam the ball detent 106 against the force of the compressed gas so the ball detent 106 passes into the slot 104 thereby latching onto the sleeve 38 when it is on the decoupler 30 and preventing it from falling immediately into the well 10. Upon a signal from a controller (not shown), gas pressure is bled from the cylinder 108 allowing the spring 114 to retract the piston 112 and allowing the weight of the sleeve 38 to push the ball detent 106 out of the slot 104 thereby releasing the sleeve 38 for movement downwardly into the well 10.

When it is desired to retrieve the mandrel 40 or the piston 26, the decoupler 30 is replaced with a similar device having a stop 100 but eliminating the rod 92. This causes the piston 26 to impact the bumper 28 without dislodging the mandrel 40. The piston 26 is held in its upward position by the flow of formation products around the piston 26 in conjunction with the catcher 32 which latches onto the sleeve 38.

Operation of the plunger lift 18 of this invention should now be apparent. The mandrel 40 is first dropped into the well 10. It falls rapidly through a rising stream of produced products onto the bumper 34 which substantially cushions the impact and minimizes damage to the mandrel 40. When the sleeve 38 is released by the catcher 32, it falls through the well 10 to the bottom. Because the pin 72 of the mandrel 40 is aligned with the axis 66, the sleeve 38 passes over the pin 72, impacts the top of the plate 68 and seals against the sealing member 80. The combined downwardly surface area of the sleeve 38 and mandrel 40, in their united configuration, is sufficient to allow gaseous products from the formation 14 to push the piston 26, and any liquid above it, upwardly to the well head assembly 20.

As the piston 26 approaches the well head assembly 20, a slug of liquid passes through the wing valve 24 into the flow line 102 toward a surface treatment facility. The sleeve 36 passes over the rod 92 which stops upward movement of the mandrel 40 thereby releasing the mandrel 40 which drops into the well 10 in the start of another cycle. The sleeve 38 is retained by the catcher 32 for a period of time depending on the requirements of the well 10. If the well 10 needs to be cycled as often as possible, the delay provided by the catcher 30 is only long enough to be sure the mandrel 40 will reach the bottom of the well 10 before the sleeve 38. In more normal situations, the sleeve 38 will be retained on the catcher 30 so the piston 26 cycles much less often.

A prototype of this invention has been tested. In a 6000' gas well that loads up and dies with produced liquid, it took seven minutes for the mandrel and sleeve to fall separately to the bottom of the well through the upwardly moving column of gas and water, recombine and return to the surface with ¼ barrels of water.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A plunger lift for a well producing through a production string communicating with a hydrocarbon formation, comprising a free piston having at least two sections, movable independently downwardly in the well, the sections being united at the bottom of the well for upward movement together in the well and having an exterior seal for pushing liquid, above the piston, upwardly, wherein the sections nest together during upward movement in the well.

2. The plunger lift of claim 1 wherein the piston comprises an upper section, a lower section and no other section.

3. The plunger lift of claim 2 wherein a first of the sections comprises a sleeve having the seal thereon and a central passage therethrough and a second of the sections comprises a mandrel having a pin receivable in the sleeve during upward movement in the well.

4. The plunger lift of claim 1 further comprising means for sealing between the first and second sections when the sections nest together.

5. The plunger lift of claim 4 wherein the first section comprises an upper section and the second section comprises a lower section, below the upper section.

6. The plunger lift of claim 5 wherein the lower section provides at least one centralizer for centering the lower section in the production string.

7. The plunger lift of claim 5 wherein the lower section provides at least two axially spaced centralizers for centering the lower section in the production string.

8. The plunger lift of claim 1 wherein the sections are separated during downward movement into the well.

9. The plunger lift of claim 1 comprising a bumper spring for positioning near the formation for engaging and cushioning impact of one of the sections at a location adjacent an end of downward movement in the well.

10. The plunger lift of claim 9 comprising a catcher for catching a first of the sections at a location adjacent an end of upward movement in the well.

11. The plunger lift of claim 10 comprising means for releasing the first section from the catcher.

12. A plunger lift for a well producing through a production string communicating with a hydrocarbon formation, comprising a free piston having at least two sections, movable independently downwardly in the well, the sections being united at the bottom of the well for upward movement together in the well and having an exterior seal for pushing liquid, above the piston, upwardly, a first of the sections provides a first flow bypass around the first section allowing the first section to move downwardly in the well against the flow of formation products upwardly in the well and a second section of the sections provides a restrictor for reducing the size of the first flow bypass when the first and second sections are united.

13. A plunger lift for a well producing through a production string communicating with a hydrocarbon formation, comprising a free piston having at least two sections, movable independently downwardly in the well, the sections being united at the bottom of the well for upward movement together in the well and having an exterior seal for pushing liquid, above the piston, upwardly and means for separating the sections adjacent an end of upward movement in the well.

14. The plunger lift of claim 13 comprising means for catching a first of the sections at a location adjacent the end of upward movement in the well and allowing a second of the sections to fall into the well.

15. A plunger lift for a well producing through a production string communicating with a hydrocarbon formation, comprising a free piston having at least upper and lower sections, movable independently downwardly in the well, the sections being united at the bottom of the well for upward movement together in the well and having an exterior seal for pushing liquid, above the piston, upwardly, the lower section being configured to move upwardly upon exposure to a predetermined pressure differential before the upper section moves.

16. The plunger lift of claim 15 wherein the lower section has more downwardly facing area than the upper section whereby a pressure differential across the united upper and lower sections produces a greater upward force on the lower section than on the upper section if the sections move apart.

17. In a plunger lift for lifting liquids from a well producing through a production string communicating with a hydrocarbon formation, comprising a piston having separate sections movable independently downwardly into the well, each of the separate sections providing a downwardly facing cross-sectional area that is insufficient to move the section upwardly in response to gas flow emitting from the formation.

18. The plunger lift of claim 17 wherein a first of the sections is an upper section and a second of the sections is a lower section, the lower section having more downwardly facing area than the upper section whereby a pressure differential across the united upper and lower sections produces a greater upward force on the lower section than on the upper section if the sections move apart.

19. In a plunger lift for lifting liquids from a well producing through a production string communicating with a hydrocarbon formation and through a well head, comprising a piston and a decoupler adjacent the well head for separating the piston into separate sections in response to upward movement of the piston thereby allowing the sections to fall separately into the well;

means uniting the sections together adjacent the formation for movement together upwardly in the production string to push liquids upwardly in the well in response to gas flow into the production string from the formation;

a bumper spring inside the production string adjacent the formation for engaging the piston and cushioning impact near an end of downward piston movement; and a catcher adjacent the well head for catching a first of the sections and means for releasing the first section in response to a signal.

20. A multipart piston for a plunger lift comprising an upper sleeve providing a central passage and an exterior seal assembly; and a lower mandrel movable from a first position out of contact with the upper sleeve to a second position coupled with the sleeve and having at least one centralizer and a pin received in the passage in the second position and providing a fishing shoulder intermediate the passage.

21. The multipart piston of claim 20 further comprising means for sealing between the sleeve and mandrel.

22. The multipart piston of claim 20 further comprising a fishing shoulder on the upper sleeve.

23. A method of lifting liquids from a well producing hydrocarbons from a formation with a plunger lift having a multipart piston, comprising dropping parts of the piston independently in the well, uniting the parts of the piston into a unit near the formation and moving the unit upwardly in the well in response to formation gases passing into the well and thereby pushing liquid upwardly with the piston.

24. The method of claim 23 wherein the dropping step occurs when gas is flowing upwardly in the well.

25. The method of claim 23 wherein the well includes a well head and wherein the dropping step occurs when gas is flowing upwardly in the well and exiting through the well head.

26. The method of claim 23 wherein the dropping step comprises dropping a first part of the piston into the well, pausing for a time period and then dropping a second part of the piston into the well.

27. The method of claim 26 further comprising repeatedly dropping the first and second parts of the piston into the well and varying the time period between dropping the first part and dropping the second part.

28. A plunger lift for a well producing through a production string communicating with a hydrocarbon formation, comprising a free piston having at least first and second sections, movable independently downwardly in the well, the sections being united at the bottom of the well for upward movement together in the well and having an exterior seal for pushing liquid, above the piston, upwardly, the first section comprising a sleeve having means on the exterior of the sleeve for minimizing fluid bypass on the outside of the sleeve and a passage allowing formation contents to flow through the sleeve when the sleeve is falling into the well and the second section includes a restrictor for reducing flow through the passage when the sections unite at the bottom of the well.

29. A plunger lift for a well producing through a production string communicating between a hydrocarbon formation and a well head, comprising a free piston having at least first and second sections, movable independently downwardly in the well, the sections including means joining the sections together at the bottom of the well for upward movement together in the well and having an exterior seal for pushing liquid, above the piston, upwardly.

30. The plunger lift of claim 29 wherein the well head comprises a decoupler for separating the free piston into separate sections.

31. The plunger lift of claim 30 wherein the first section comprises a passage therethrough and the second section comprises a restrictor for reducing the size of the passage and the decoupler comprises a downwardly extending member projecting at least partially through the passage for engaging the restrictor and dislodging the second section from the first section.

* * * * *

US006209637C1

(12) EX PARTE REEXAMINATION CERTIFICATE (6377th)

United States Patent

Wells

(10) Number: US 6,209,637 C1

(45) Certificate Issued: Aug. 19, 2008

(54) PLUNGER LIFT WITH MULTIPART PISTON AND METHOD OF USING THE SAME

(75) Inventor: Edward A. Wells, Corpus Christi, TX (US)

(73) Assignee: MGM Well Service, Inc., Corpus Christi, TX (US)

Reexamination Request:
No. 90/007,597, Jun. 22, 2005

Reexamination Certificate for:

| | |
|---|---|
| Patent No.: | **6,209,637** |
| Issued: | **Apr. 3, 2001** |
| Appl. No.: | **09/312,737** |
| Filed: | **May 14, 1999** |

(51) Int. Cl.

| | |
|---|---|
| ***F04B 47/00*** | (2006.01) |
| ***F04B 47/12*** | (2006.01) |
| ***E21B 43/12*** | (2006.01) |
| ***E21B 43/00*** | (2006.01) |

(52) U.S. Cl. ..... 166/153; 166/372

(58) Field of Classification Search ..... None
See application file for complete search history.

(56) References Cited

U.S. PATENT DOCUMENTS

| | | | | |
|---|---|---|---|---|
| 971,612 | A | 10/1910 | Holliday | |
| 1,769,637 | A | 7/1930 | Fletcher et al. | |
| 1,784,096 | A | 12/1930 | Fletcher | |
| 1,819,994 | A | 8/1931 | Claytor | |
| 1,833,778 | A | 11/1931 | Fletcher | |
| 1,836,842 | A | 12/1931 | Fletcher | |
| 1,836,843 | A | 12/1931 | Fletcher | |
| 1,836,871 | A | 12/1931 | Ricker | |
| 1,836,912 | A | 12/1931 | Fletcher | |
| 1,844,074 | A | 2/1932 | Ricker | |
| 1,896,232 | A | 2/1933 | Fletcher | |
| 1,905,058 | A | 4/1933 | Ricker | |
| 1,919,547 | A | 7/1933 | Fletcher | |
| 1,922,396 | A | 8/1933 | Ricker | 103/52 |
| 1,932,451 | A | 10/1933 | Evans | 103/52 |
| 1,947,587 | A | 2/1934 | Fletcher | 103/52 |
| 1,989,035 | A | 1/1935 | Blum | 166/18 |
| 1,993,258 | A | 3/1935 | Bettis | 103/52 |
| 1,993,266 | A | 3/1935 | Evans | 103/52 |
| 1,993,292 | A | 3/1935 | Woods | 103/52 |
| 2,001,012 | A | 5/1935 | Burgher | |
| 2,001,551 | A | 5/1935 | Scott | 103/52 |
| 2,001,552 | A | 5/1935 | Scott | 103/52 |
| 2,013,111 | A | 9/1935 | Scott | 103/52 |
| 2,018,204 | A | 10/1935 | Evans et al. | 103/52 |
| 2,018,205 | A | 10/1935 | Evans | 103/52 |

(Continued)

FOREIGN PATENT DOCUMENTS

| | | |
|---|---|---|
| SU | 176541 | 11/1965 |
| SU | 182634 | 6/1966 |
| SU | 188423 | 11/1966 |
| SU | 171351 | 5/1969 |
| SU | 596710 | 3/1978 |
| SU | 791939 | 12/1980 |
| SU | 802525 | 2/1981 |

OTHER PUBLICATIONS

I. Shulyatikov et al., Removing Liquid from Gas Wells by "Well Shuttles," Corrosion & Prevention 2001, Sep. 29–Oct. 2, 2002, Orlando, Fla.

A.A. Popov, Experience in Inroducing Plunger Lift at Fields of the Ukhta Complex, Gazovoe delo, No. 9, at 23–26 (1968).

B.V. Panasov & I.F. Firsov, Some Results of Plunger Lift Use at the Saushinsk Gas Field, Gazovoe delo, No. 7, at 18–21 (1969).

Integrated Production Service, Inc. catalog pages entitled Models Lubricator.

*Primary Examiner*—David O. Reip

(57) ABSTRACT

A plunger lift for a hydrocarbon well includes a multipart piston that is dropped into the well in separate pieces. When the pieces reach the bottom of the well, they fall into an accumulation of the formation liquid in the bottom of the well and unite. Gas from the formation pushes the unit upwardly, pushing liquid above the piston toward the surface.

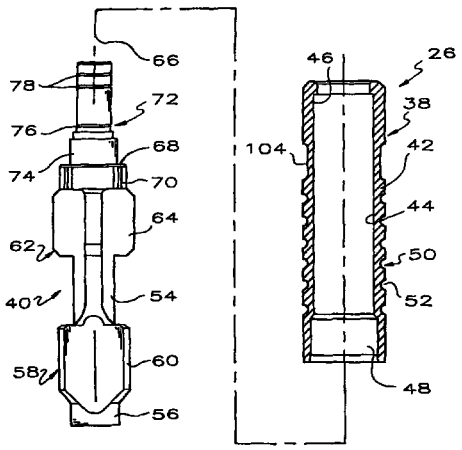

U.S. PATENT DOCUMENTS

| | | | | |
|---|---|---|---|---|
| 2,058,825 | A | 10/1936 | Rallet et al. | 166/18 |
| 2,074,912 | A | 3/1937 | Hutto | |
| 2,184,393 | A | 12/1939 | Luccous | 166/18 |
| 2,237,408 | A | 4/1941 | Burgher | |
| 2,508,174 | A | 5/1950 | Knox et al. | 103/52 |
| 2,555,112 | A | 5/1951 | Brown | 103/52 |
| 2,642,002 | A | 6/1953 | Knox et al. | 103/52 |
| 2,649,738 | A | 8/1953 | Tait | 103/52 |
| 2,661,024 | A | 12/1953 | Knox | 137/692 |
| 2,674,201 | A | 4/1954 | Talbott | 103/225 |
| 2,674,951 | A | 4/1954 | Zaba | 103/52 |
| 2,676,547 | A | 4/1954 | Knox | 106/46 |
| 2,684,633 | A | 7/1954 | Knox | 103/52 |
| 2,699,121 | A | 1/1955 | Knox | 103/52 |
| 2,757,614 | A | 8/1956 | Spalding | 103/52 |
| 2,762,309 | A | 9/1956 | Knox | 103/52 |
| 2,762,310 | A | 9/1956 | Eklund | 103/52 |
| 2,789,645 | A | 4/1957 | Curnutt et al | 166/170 |
| 2,791,181 | A | 5/1957 | Knox | 103/52 |
| 2,802,535 | A | 8/1957 | Taylor | 166/170 |
| 2,821,142 | A | 1/1958 | Knox | 103/52 |
| 2,878,754 | A | 3/1959 | McMurry | 103/52 |
| 2,884,861 | A | 5/1959 | Vincent et al. | 103/52 |
| 2,893,493 | A | 7/1959 | Copas | 166/170 |
| 2,918,015 | A | 12/1959 | Knox | 103/52 |
| 2,937,598 | A | 5/1960 | Brown | 103/52 |
| 2,962,978 | A | 12/1960 | Reeves | 103/225 |
| 2,970,547 | A | 2/1961 | McMurry | 103/52 |
| 3,012,512 | A | 12/1961 | Shaw | 103/52 |
| 3,012,513 | A | 12/1961 | Knox | 103/52 |
| 3,012,832 | A | 12/1961 | Knox | 309/23 |
| 3,020,852 | A | 2/1962 | Roach et al. | 103/225 |
| 3,031,971 | A | 5/1962 | Roach | 103/52 |
| 3,034,581 | A | 5/1962 | Reynolds | 166/174 |
| 3,037,558 | A | 6/1962 | McGowen, Jr. et al. | 166/170 |
| 3,039,394 | A | 6/1962 | Brown et al. | 103/52 |
| 3,055,306 | A | 9/1962 | Tausch | 103/52 |
| 3,090,315 | A | 5/1963 | Milton | 103/52 |
| 3,090,316 | A | 5/1963 | Montgomery | |
| 3,095,819 | A | 7/1963 | Brown et al. | 103/52 |
| 3,147,808 | A | 9/1964 | McCarvell et al. | 166/70 |
| 3,150,596 | A | 9/1964 | Knox | 103/52 |
| 3,171,487 | A | 3/1965 | Ault | 166/65 |
| 3,176,619 | A | 4/1965 | Shaw | 103/52 |
| 3,181,470 | A | 5/1965 | Clingman | 103/52 |
| 3,229,768 | A | 1/1966 | Lunebring | 166/170 |
| 3,249,056 | A | 5/1966 | Lyles | 103/52 |
| 3,273,504 | A | 9/1966 | Lyles | 103/52 |
| 3,304,874 | A | 2/1967 | Lyles | 103/52 |
| 3,329,211 | A | 7/1967 | Roach | 166/170 |
| 3,394,763 | A | 7/1968 | Page, Jr. | 166/170 |
| 3,412,798 | A | 11/1968 | Gregston | |
| 3,424,066 | A | 1/1969 | Moore, Jr. | 92/193 |
| 3,424,093 | A | 1/1969 | Moore, Jr. | 103/52 |
| 3,456,727 | A | 7/1969 | Nettles | 166/170 |
| 4,007,784 | A | 2/1977 | Watson et al. | 166/70 |
| 4,070,134 | A | 1/1978 | Gramling | 417/56 |
| 4,211,279 | A | 7/1980 | Isaacks | |
| 4,410,300 | A | 10/1983 | Yerian | 417/56 |
| 4,417,858 | A | 11/1983 | Stout | 417/58 |
| 4,629,004 | A | 12/1986 | Griffin | |
| 4,716,970 | A | 1/1988 | Henning | 166/372 |
| 4,921,048 | A | 5/1990 | Crow et al. | 166/372 |
| 4,923,011 | A | 5/1990 | Skipper | 166/311 |
| 5,012,866 | A | 5/1991 | Skipper | 166/170 |
| 5,335,727 | A | 8/1994 | Cornette | |
| 5,415,227 | A | 5/1995 | Jennings | |
| 6,045,335 | A | 4/2000 | Dinning | |
| 6,148,923 | A | 11/2000 | Casey | |
| 6,173,783 | B1 | 1/2001 | Abbott-Brown et al. | 166/370 |
| 6,705,404 | B2 | 3/2004 | Bosley | 166/372 |

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 10, 14, 19–22, 26 and 27 are cancelled.

Claims 1, 3, 11–13, 15, 17, 18, 23 and 28–30 are determined to be patentable as amended.

Claims 2, 4–9, 16, 24, 25 and 31, dependent on an amended claim are determined to be patentable.

New claims 32–55 are added and determined to patentable.

1. A plunger lift for a well producing through *an above ground well head and* a production string communicating with a hydrocarbon formation, comprising a free piston having at least two sections, movable independently downwardly in the well, the section being united at the bottom of the well for upward movement together in the well and having an exterior seal for pushing liquid, above the piston, upwardly, wherein the sections nest together during upward movement in the well*;*

*the sections comprising an upper sleeve having a passage therethrough and a lower member lodging in the passage during upward movement in the well, the lower member being free of a passage connecting any opposite sides of the lower member, the ratio of surface area to weight of the lower member being greater than the radio of surface area to weight of the upper member, the surface areas being surface areas effective to move the sections upon the creation of a differential pressure thereacross;*

*a separating rod for receiving the sleeve near an end of upward movement of the piston in the well and thereby dislodging the lower member from the sleeve for separating the piston sections adjacent the end of upward movement in the well, the separating rod having a lower end in the well head above ground level; and*

*a device for holding the sleeve in the well head above ground level.*

3. The plunger lift of claim 2 wherein [a first of the sections comprises a] *the* sleeve [having] *provides* the seal thereon and *further comprising* a central passage therethrough and a second of the sections comprises a mandrel having a pin receivable in the sleeve during upward movement in the well.

11. The plunger lift of claim [10] *1* comprising means for releasing the [first section] *sleeve* from the [catcher] *device.*

12. A plunger lift for a well producing through a production string communicating with a hydrocardon formation *and through a well head above ground level providing a valve for closing the production string*, comprising a free piston having at least two sections, movable independently downwardly in the well, the sections being united at the bottom, of the well for upward movement together in the well and having an exterior seal for pushing liquid, above the piston, upwardly, a first of the sections provides a first flow bypass around the first section allowing the first section to move downwardly in the well against the flow of formation products upwardly in the well and a second section of the sections provides a restrictor for reducing the size of the first flow bypass when the first and second sections are united*, the sections comprising an upper sleeve and a lower member, the lower member being free of a passage connecting any opposite sides of the lower member, the ratio of surface area to weight of the lower member being greater than the ratio of surface area to weight of the upper member, the surface areas being surface areas effective to move the sections upon the creation of a differential pressure thereacross;*

*a decoupler, on the well head and above ground level, for separating the piston into separate sections in response to upward movement of the piston thereby allowing the sections to fall separately into the well, the decoupler being removable from the well head to provide a location wherein the piston sections jointly collect, the well head including a gas flow passage below the location so the piston sections may be removed from the well head after removing the decoupler and closing the valve; and*

*a device on the well head for holding a first of the sections and then releasing the first section in response to a signal.*

13. A plunger lift for a well producing through a production string communicating with a hydrocarbon formation, comprising a free piston having at least [two sections] *an upper section and a lower section*, movable independently downwardly in the well, the sections being united at the bottom of the well for upward movement together in the well and having an exterior seal for pushing liquid, above the piston, upwardly [and], *the lower section being free of a passage connecting any opposite side of the lower section, the ratio of surface area to weight of the lower section being greater than the ratio of surface area to weight of the upper section, the surface areas being surface areas effective to move the sections upon the creations of a differential pressure thereacross;* means for separating the sections adjacent an end of upward movement in the well*; and*

*a device for holding the upper section adjacent the end of upward movement in the well for a time at least sufficient to allow the lower section to fall to the bottom of the well before the upper section reaches the bottom of the well.*

15. A plunger lift for a well producing through a production string communicating with hydrocarbon formation *and through a well head above ground level*, comprising a free piston having at least upper and lower sections, movable independently downwardly in the well, the sections being united at the bottom of the well for upward movement together in the well and having an exterior seal for pushing liquid, above the piston, upwardly, the lower section being configured to move upwardly upon exposure to a predetermined pressure differential before the upper section moves*, the sections comprising an upper sleeve and a lower member, the*

*lower member being free of a passage connecting any opposite sides of the lower member, the ratio of surface area to weight of the lower member being greater than the ratio of surface area to weight of the upper member, the surface areas being surface areas effective to move the sections upon the creation of a differential pressure thereacross;*

*a decoupler for separating the piston into separate sections at a location in the well head in response to upward movement of the piston thereby allowing the sections to fall separately into the well;*

*a device for delaying downward movement of the upper section from the location during each cycle of movement of the upper section, the duration of the delay being sufficient to allow the lower section to reach a position adjacent the formation before the upper section reaches the position; and*

*a controller for varying duration of the delay.*

17. In a plunger lift for lifting liquids from a well producing through a production string communicating with a hydrocarbon formation, comprising a piston having a separate *upper and lower* sections movable independently downwardly into the well, each of the separate sections providing a downwardly facing cross-sectional area that is insufficient to move the section upwardly in response to gas flow emitting from the formation, *the upper section comprising a sleeve having a first ratio of surface area to weight, the lower section being free of a passage connecting any opposite sides of the lower section, and the lower section having a second ratio of surface area to weight, the second ratio being higher than the first ratio, the surface area of the upper section being a surface area effective to move the upper section upon the creation of a differential pressure thereacross, the surface area of the lower section being a surface area effective to move the lower section upon the creation of a differential pressure thereacross.*

18. The plunger lift of claim 17 wherein [a first of the sections is an upper section and a second of the sections is a lower section,] the lower section having more downwardly facing area than the upper section whereby a pressure differential across the united upper and lower sections produces a greater upward force on the lower section than on the upper section if the sections move apart.

23. A method of lifting liquids from a *gas* well producing *gaseous* hydrocarbons from a formation with a plunger lift having a multipart piston *comprising an upper sleeve having a passage therethrough and lower member sized to close the passage during upward movement of the sleeve and a lower member, the sleeve having a ratio of surface area to weight, the lower member being free of a passage connecting any opposite sides of the lower member, and having a ratio of surface area to weight greater than the ratio surface area to weight of the sleeve, the surface areas being surface areas effective to move the sleeve and lower member upon the creation of a differential pressure thereacross*, comprising dropping [parts of the piston] *the sleeve and lower member* independently in the well, uniting the [parts of the piston] *sleeve and lower member* into a unit near the formation and moving the unit upwardly in the well in response to formation gases passing into the well and thereby pushing liquid upwardly with the piston, *wherein the dropping step comprises repeatedly dropping a first part of the piston into the well, pausing for a time period, then dropping a second part of the piston into the well and varying the time period between successive drops.*

28. A plunger lift for a well producing through a production string communicating with a hydrocarbon formation, comprising a free piston having at least [first] *upper* and [second] *lower* sections, movable independently downwardly in the well, the sections being united at the bottom of the well for upward movement together in the well and having an exterior seal for pushing liquid, above the piston, upwardly, the [first] *upper* section comprising a sleeve having means on the exterior of the sleeve for minimizing fluid bypass on the outside of the sleeve and a passage allowing formation contents to flow through the sleeve when the sleeve is falling into the well and the [second] *lower* section includes a restrictor for reducing flow through the passage when the sections unite at the bottom of the well, *the sleeve having a first ratio of surface area to weight and the lower section having a second ratio of surface area to weight, the second ratio being higher than the ratio, the surface area of the sleeve being a surface area effective to move the sleeve upon the creation of a differential pressure thereacross, the surface area of the lower section being a surface area effective to move the lower section upon the creation of a differential pressure thereacross, the lower section being free of a passage connecting any opposite sides of the lower section;*

*a decoupler for separating the upper and lower sections at a location adjacent upward movement in the well and allowing the lower section to fall into the well;*

*a device for holding the upper section adjacent the location and, after a time period, dropping the upper section into the well; and*

*a controller for varying the time period.*

29. A plunger lift for a well producing through a production string communicating between a hydrocarbon formation and a well head, comprising a free piston having at least first *upper* and second *lower* sections, movable independently downwardly in the well, the sections including means joining the sections together at the bottom of the well for upward movement together in the well and having an exterior seal for pushing liquid, above the piston, upwardly, *the upper section comprising a sleeve having a passage therethrough and the lower section comprising a member filling the passage during upward movement, the member being free of a passage connecting any opposite sides of the member, the ratio of surface area to weight of the lower section being greater than the ratio of surface area to weight of the upper section.*

30. The plunger lift of claim 29 wherein the well head *is above ground level and* comprises a decoupler for separating the free piston into separate sections, *the decoupler comprising a separating rod having a lower end in the well head above ground level.*

*32. The plunger lift of claim 2 wherein the well head comprises a flow line opening into the well head above an uppermost position of the upper section, and a bypass conduit opening into the well head below the bottom of the upper section in its uppermost position, the bypass conduit being connected to the flow line.*

*33. The plunger lift of claim 1 wherein the well produces through the head providing a valve closing the production string, the separating rod being removable from adjacent the well head to provide a location where the piston sections jointly collect, the well head including a gas flow passage below the location so the piston sections remain united in response to the flow of gas through the well head whereby the joined piston sections may be removed from the well head after removing the separating rod and closing the valve.*

*34. The plunger lift of claim 1 wherein the lower member comprises a closed exterior surface free of openings into an interior of the lower member.*

*35. The plunger lift of claim 12 wherein the piston sections comprise an upper section and a lower section and the well head comprises a flow line opening into the well head above an uppermost position of the upper section, and a bypass conduit opening into the well head below the bottom of the upper section in its uppermost position, the bypass conduit being connected to the flow line.*

*36. The plunger lift of claim 12 wherein the lower member comprises a closed exterior surface free of openings into an interior of the lower member.*

*37. The plunger lift of claim 13 wherein the well produces through a well head above ground level and the device, on the well head, holds the upper section above ground level.*

*38. The plunger lift of claim 13 wherein the device physically contacts the upper section.*

*39. The plunger lift of claim 13 wherein the well produces through a well head above ground level, the upper section comprises a sleeve having a passage therethrough and the lower section nests in the passage during upward movement in the well and the separating means comprises a rod for receiving the sleeve near the end of upward movement of the piston and thereby dislodging the lower section from the upper section and wherein the device holds the sleeve in the well head above ground level.*

*40. The plunger lift of claim 13 wherein the well head comprises a flow line opening into the well head above an uppermost position of the upper section, and a bypass conduit opening into the well head below the bottom of the upper section in its uppermost position, the bypass conduit being connected to the flow line.*

*41. The plunger lift of claim 13 wherein the lower section comprises a closed exterior surface free of openings into an interior of the lower section.*

*42. The plunger lift of claim 15 wherein the sleeve provides a recess on a side thereof and the device comprises a retractable detent for extending into the recess and the thereby holding the sleeve.*

*43. The plunger lift of claim 15 wherein the well head comprises a flow line opening into the well head above an uppermost position of the upper section, and a bypass conduit opening into the well head below the bottom of the upper section in its uppermost position, the bypass conduit being connected to the flow line.*

*44. The plunger lift of claim 15 wherein the lower member comprises a closed exterior surface free of openings into an interior of the lower member.*

*45. The plunger lift of claim 17 wherein the well produces through a well head comprising a flow line opening into the well head above an uppermost position of the upper section, and a bypass conduit opening into the well head below the bottom of the upper section in its uppermost position, the bypass conduit being connected to the flow line.*

*46. In the plunger lift of claim 17 wherein the lower section comprises a closed exterior surface free of openings into an interior of the lower section.*

*47. The method of claim 23 wherein the lower member comprises a closed exterior surface free of openings into an interior of the lower member.*

*48. The plunger lift of claim 28 wherein the well produces through a well head and the production string and the well head comprises a flow line opening into the well head above an uppermost position of the sleeve, and a bypass conduit opening into the well head below the bottom of the sleeve in its uppermost position, the bypass conduit being connected to the flow line.*

*49. The plunger lift of claim 28 wherein the lower section comprises a closed exterior surface free of openings into an interior of the lower section.*

*50. The plunger lift of claim 29 wherein the surface areas are surface areas effective to move the upper and lower sections upon the creation of differential pressures across the upper and lower sections.*

*51. The plunger lift of claim 29 wherein the well head comprises a flow line opening into the well head above an uppermost position of the upper section, and a bypass conduit opening into the well head below the bottom of the upper section in its uppermost position, the bypass conduit being connected to the flow line.*

*52. The plunger lift of claim 29 wherein the member comprises a closed exterior surface free of openings into an interior of the lower member.*

*53. A plunger lift for a well producing through a production string communicating with a hydrocarbon formation, comprising*

*a free piston having an upper sleeve and a lower imperforate member, movable independently downwardly in the well, the sleeve and member being united at the bottom of the well for upward movement together in the well and having an exterior seal for pushing liquid, above the piston, upwardly,*

*each of the upper sleeve and lower member providing a downwardly facing cross-sectional area that is insufficient to move the section upwardly in response to gas flow emitting from the formation and*

*wherein the relationship between the sleeve and lower member is such that the lower member moves upwardly easier than the sleeve at a given pressure differential,*

*the ratio of surface area to weight of the lower member being greater than the ratio of surface area to weight of the sleeve.*

*54. The plunger lift of claim 53 where the surface areas are surface areas effective to move the sections upon the creation of a differential pressure thereacross.*

*55. A plunger lift for a well producing through a production string communicating with a hydrocarbon formation, comprising*

*a free piston having an upper sleeve and a lower member, movable independently downwardly in the well, the sleeve and member being united at the bottom of the well for upward movement together in the well and having an exterior seal for pushing liquid, above the piston, upwardly,*

*the lower member providing an exterior establishing with the production string an exclusive flow path for formation products past the lower member during downward movement in the well;*

*each of the upper sleeve and lower member providing a downwardly facing cross-sectional area that is insufficient to move the section upwardly in response to gas flow emitting from the formation and*

*wherein the relationship between the sleeve and lower member is such that the lower member moves upwardly easier than the sleeve at a given pressure differential,*

*the ratio of surface area to weight of the lower member being greater than the ratio of surface area to weight of the sleeve.*

* * * * *